US010404003B2

(12) United States Patent
Dendas

(10) Patent No.: US 10,404,003 B2
(45) Date of Patent: Sep. 3, 2019

(54) INTERFACE MODULE

(71) Applicant: TE Connectivity Nederland B.V., s'Hertogenbosch (NL)

(72) Inventor: Freddy Jean Philip Dendas, Genk (BE)

(73) Assignee: TE Connectivity Nederland B.V., s-Hertogenbosch (NL)

( * ) Notice: Subject to any disclaimer, the term of this patent is extended or adjusted under 35 U.S.C. 154(b) by 0 days.

(21) Appl. No.: 16/124,538

(22) Filed: Sep. 7, 2018

(65) Prior Publication Data

US 2019/0074624 A1 Mar. 7, 2019

(30) Foreign Application Priority Data

Sep. 7, 2017 (EP) ..... 17189976

(51) Int. Cl.

| | |
|---|---|
| ***H01R 9/03*** | (2006.01) |
| ***H01R 13/426*** | (2006.01) |
| ***H01R 13/506*** | (2006.01) |
| ***H01R 13/24*** | (2006.01) |
| ***H01R 12/71*** | (2011.01) |
| ***H01R 12/85*** | (2011.01) |

(52) U.S. Cl.

CPC ..... *H01R 13/426* (2013.01); *H01R 12/714* (2013.01); *H01R 12/85* (2013.01); *H01R 13/2442* (2013.01); *H01R 13/506* (2013.01)

(58) Field of Classification Search

CPC .. H01R 13/426; H01R 13/2442; H01R 12/85; H01R 12/714; G06F 1/1652; G06F 1/1656

See application file for complete search history.

(56) References Cited

U.S. PATENT DOCUMENTS

| | | | | |
|---|---|---|---|---|
| 3,713,079 | A | 1/1973 | Dechelette | |
| 9,864,412 | B2 * | 1/2018 | Park | G06F 1/1656 |
| 10,191,517 | B2 * | 1/2019 | Kang | G06F 1/1652 |

FOREIGN PATENT DOCUMENTS

| | | | |
|---|---|---|---|
| DE | 10 2012 012087 | A1 | 12/2013 |
| EP | 2863482 | A1 | 4/2015 |
| KR | 10-0650863 | B1 | 11/2006 |

OTHER PUBLICATIONS

Abstract of KR 10-0650863, dated Nov. 21, 2006, 1 page.
European Search Report, dated Mar. 1, 2018, 7 pages.
Abstract of DE 102012012087, dated Dec. 19, 2013, 1 page.

* cited by examiner

*Primary Examiner* — Jean F Duverne
(74) *Attorney, Agent, or Firm* — Barley Snyder

(57) ABSTRACT

An interface module comprises a base defining a planar sliding surface for a male contact element, a connector housing formed of an electrically insulating material and movably received in a receptacle of the base, a contact received in the connector housing and arranged above the planar sliding surface, and a spring disposed opposite the contact in a direction perpendicular to the sliding surface. The connector housing has an insertion opening adapted to receive the male contact element. The contact has a contact leg projecting below a planar supporting surface for the male contact element. The spring is adapted to elastically abut against an underside of the male contact element in an assembled state. The male contact element is received within the insertion opening of the connector housing and the contact leg abuts a contact surface on an upper side of the male contact element in the assembled state.

18 Claims, 10 Drawing Sheets

INTERFACE MODULE

CROSS-REFERENCE TO RELATED APPLICATION

This application claims the benefit of the filing date under 35 U.S.C. § 119(a)-(d) of European Patent Application No. 17189976.8, filed on Sep. 7, 2017.

FIELD OF THE INVENTION

The present invention relates to an interface module and, more particularly, to an interface module receiving a male contact element and having a contact and a spring.

BACKGROUND

An interface module receiving a male contact element is disclosed in Korean Patent Application No. 10-0650863. In KR 10-0650863, the male contact element is a user identification card which can be inserted into a holder of the interface module. An insertion slot of the holder exposes first contacts which make contact with contact paths provided on a main surface of the user identification card. A PCB is disposed within the holder, extends parallel to the user authentication card, and has contact paths connected to a second contact which is electrically contacted with the first contact by a biasing spring.

The interface module of KR 10-0650863 does not provide a reliable electrical connection to the male contact element inserted into the module; an expensive metal coating must be provided on the contact path in order to provide a reliable electrical connection to the user authentication card. Further, the interface module of the prior art is not adapted to accommodate different thicknesses of user identification cards inserted into the slot of the holder.

SUMMARY

An interface module comprises a base defining a planar sliding surface for a male contact element, a connector housing formed of an electrically insulating material and movably received in a receptacle of the base, a contact received in the connector housing and arranged above the planar sliding surface, and a spring disposed opposite the contact in a direction perpendicular to the sliding surface. The connector housing has an insertion opening adapted to receive the male contact element. The contact has a contact leg projecting below a planar supporting surface for the male contact element. The spring is adapted to elastically abut against an underside of the male contact element in an assembled state. The male contact element is received within the insertion opening of the connector housing and the contact leg abuts a contact surface on an upper side of the male contact element in the assembled state.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
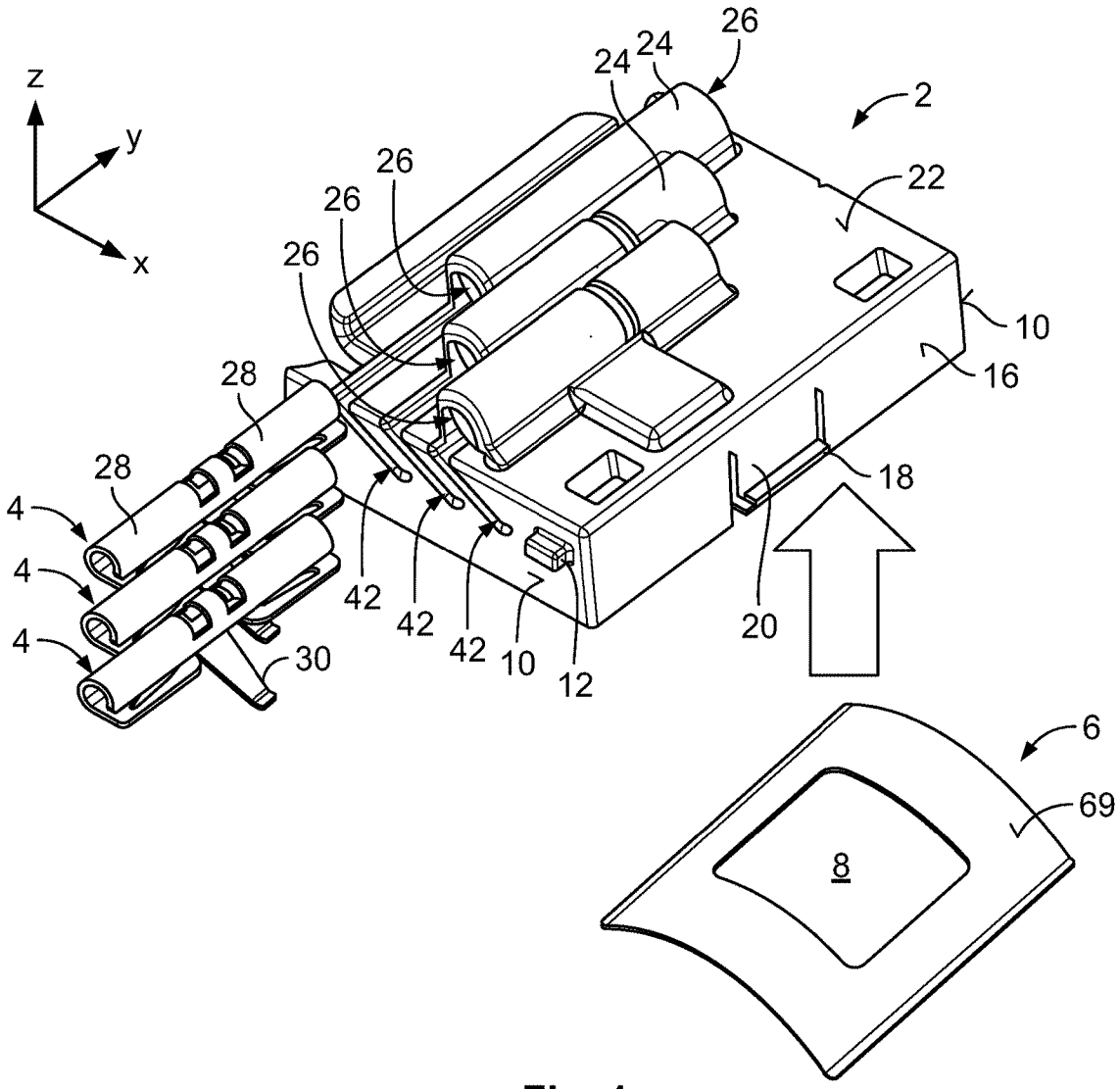
FIG. 1 is a perspective view of an interface module according to an embodiment.

The technical solutions of the present disclosure will be further specifically described below through embodiments and with reference to the accompanying drawings. In the description, the same or similar reference numerals designate the same or similar components. The following description of the embodiments of the present disclosure with reference to the drawings is intended to explain the general inventive concept of the present disclosure, and it should not be construed as limiting the present disclosure.

In addition, in the following detailed description, for purposes of explanation, numerous specific details are set forth in order to provide a thorough understanding of the disclosed embodiments. However, it is apparent that one or more embodiments may also be implemented without these specific details. In other instances, well-known structures and devices are shown schematically to simplify the drawings.

An interface module according to an embodiment is shown in FIG. 1. The interface module includes a connector housing 2 formed of a thermoplastic, electrically insulating material and made by injection molding. The connector housing 2 receives a plurality of contacts 4 and one spring 6 having a cut-out section 8.

The interface module forms a receptacle for a free end of a male contact element in the form of a PCB 50. In other embodiments, the male contact element can be any essentially planar element which has at least one contact surface and is adapted to electrically connect to electric or electronic elements or cables soldered to an interface of the male contact element. The male contact element usually has a plurality of conductive paths e.g. for providing connection of an electrical source and/or for transmitting control signals operating with electric or electronic devices and contact surfaces assigned to those contact paths, which contact surfaces are on a regular basis placed next to each other. The male contact element is usually flat with parallel main surfaces, one of which usually exposing the contact surface (s). The male contact element usually is rigid and can be made by injection molding e.g. around a contact element defining the contact surface and providing an interface. Such male contact element can be mechanically and electrically connected to a flexible foil conductive paths leading to consumers such as LEDs. When the male contact element is a PCB 50, the PCB 50 defines conductive paths to an interface e.g. to a consumer and/or to an electric or electronic device receiving control signals via the conductive path and adapted to control the consumer, which electric or electronic device can be mounted on the surface of the PCB 50 or male contact element.

Figure 2:
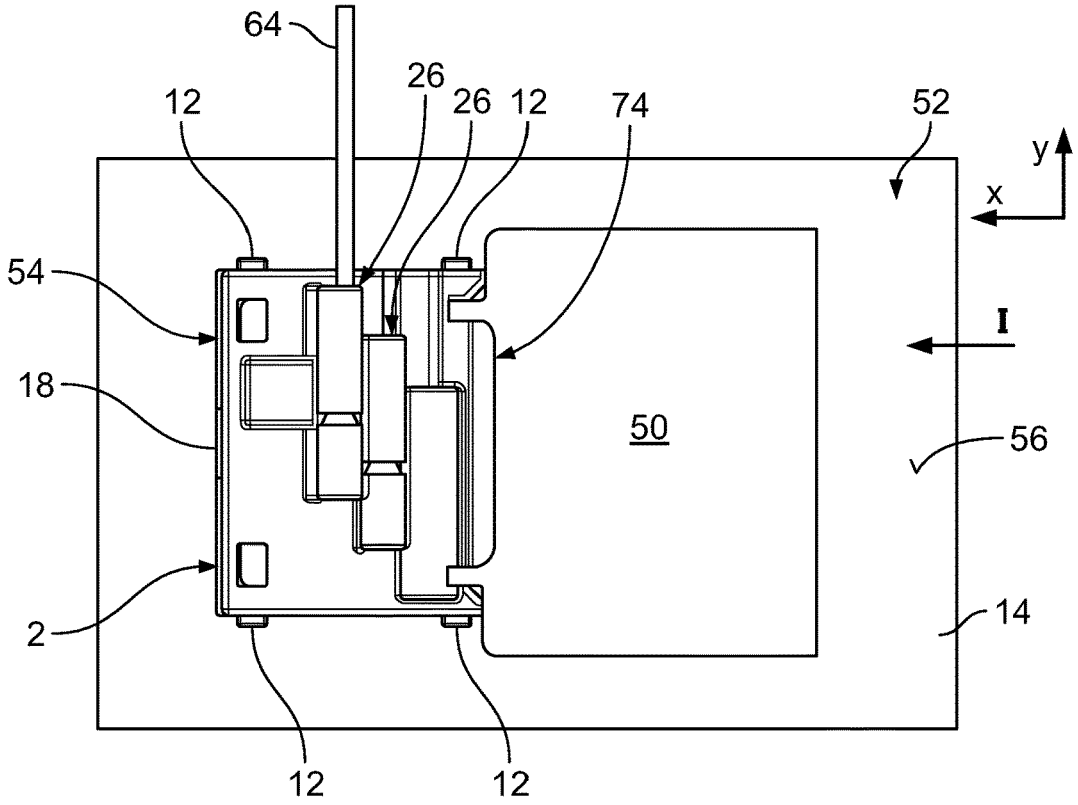
FIG. 2 is a top view of the interface module secured to a base.

The connector housing 2, as shown in FIGS. 1 and 2, has an essentially rectangular base surface and a box-like geometry. A plurality of upper stops 12 project from lateral side faces 10 of the connector housing 2, and the upper stops 12 cooperate with a base 14 shown in FIG. 2. On each lateral side face 10, two upper stops 12 are provided spaced apart in an insertion direction I in the embodiment shown in FIGS. 1 and 2. A back surface 16 of the connector housing 2 has a second locking section 18 adapted to project underneath the base 14. The second locking section 18 is provided on a free end of an elastic locking pawl 20 adapted to flex about a swiveling axis which extends in the y direction, i.e. parallel to a plane defined by a top surface 22 of the connector housing 2. A plurality of convex walls 24 project beyond the top surface 22 and each define a cylindrical receptacle 26 receiving one of the contacts 4.

Figure 11:
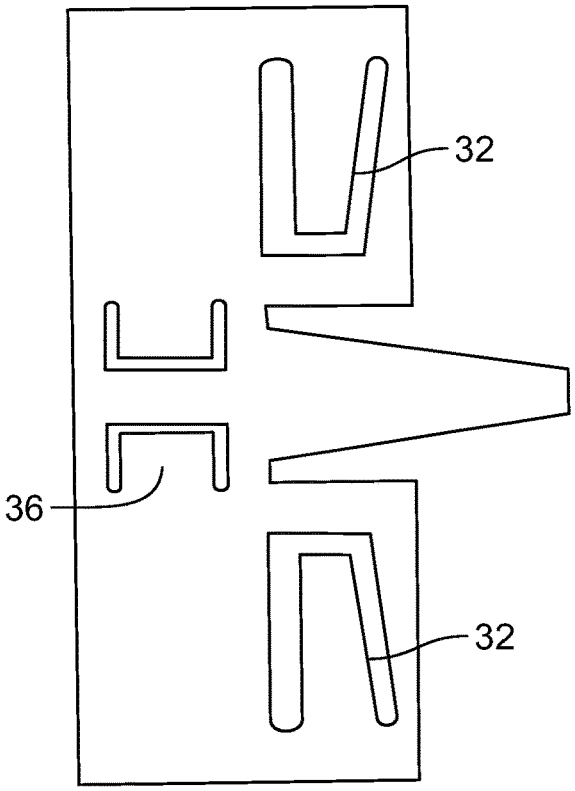
FIG. 11 is a top view of a cut-out metal sheet forming a contact of the interface module.
Figure 12:
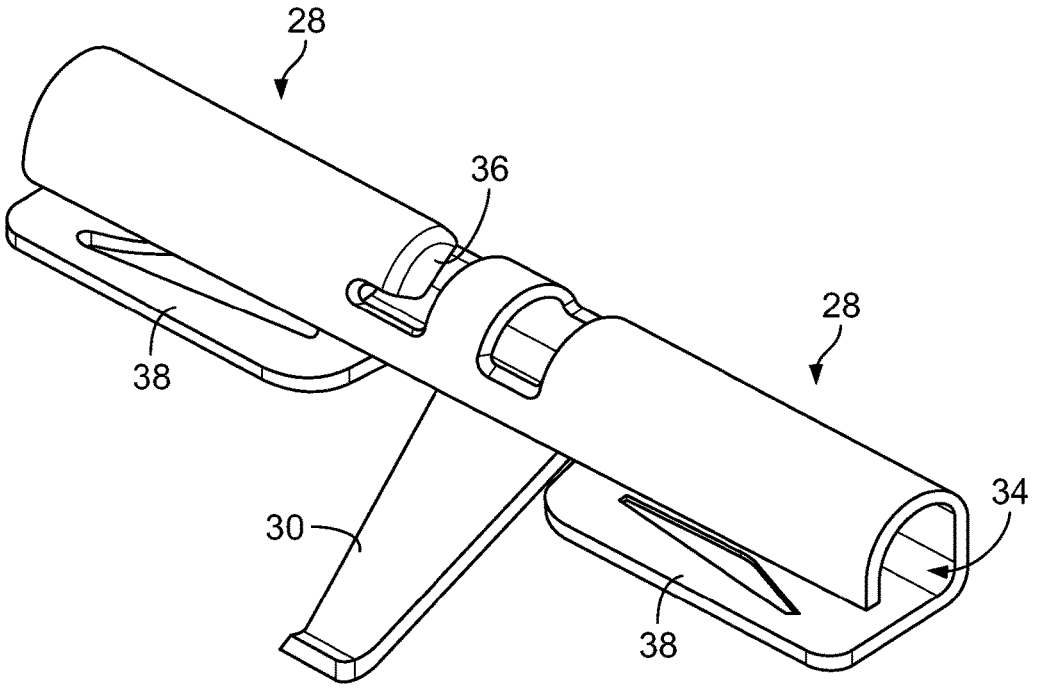
FIG. 12 is a perspective view of the contact.
Figure 13:
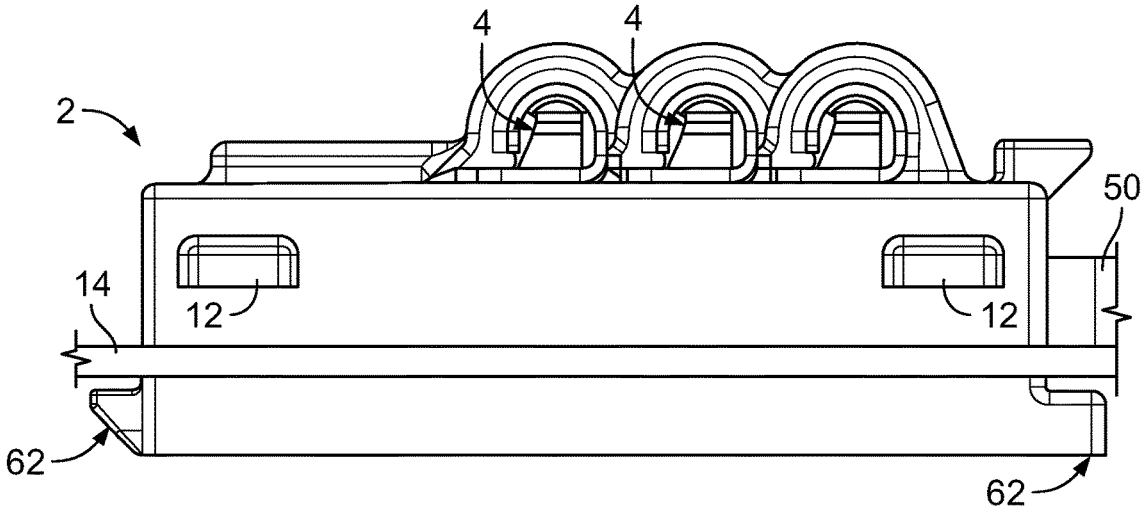
FIG. 13 is a side view of the interface module attached to the base.

Each contact 4, as shown in FIG. 1, has two opposite long segments 28 formed by cutting and bending the sheet element shown in FIG. 11 and a contact leg 30 projecting from the long segments 28 in radial direction. In an embodiment, the contact 4 is made of a copper material or copper alloy and coated with a nickel coating on top of which a tin coating is provided. As shown in FIGS. 11 and 12, the contact 4 provides securing hooks which are made by bending upward the V-shaped hook sections 32 into the long segments 28 to at least partially obstruct a cylindrical cable receptacle 34. Each securing hook is adapted to cooperate with an electrically conductive core of a cable inserted into a cable receptacle 34 to mechanically secure the cable to the contact 4. Both long segments 28 are designed identical with respect to an axis of symmetry extending through the middle of the contact leg 30. Each cable receptacle 34 has a stop made by bending a stop section 36 inwardly into the cylindrical long segments 28. Each stop prevents a cable inserted into the cable receptacle 34 from being pushed beyond the assigned cable receptacle 34 of the contact 4.

Figure 5:
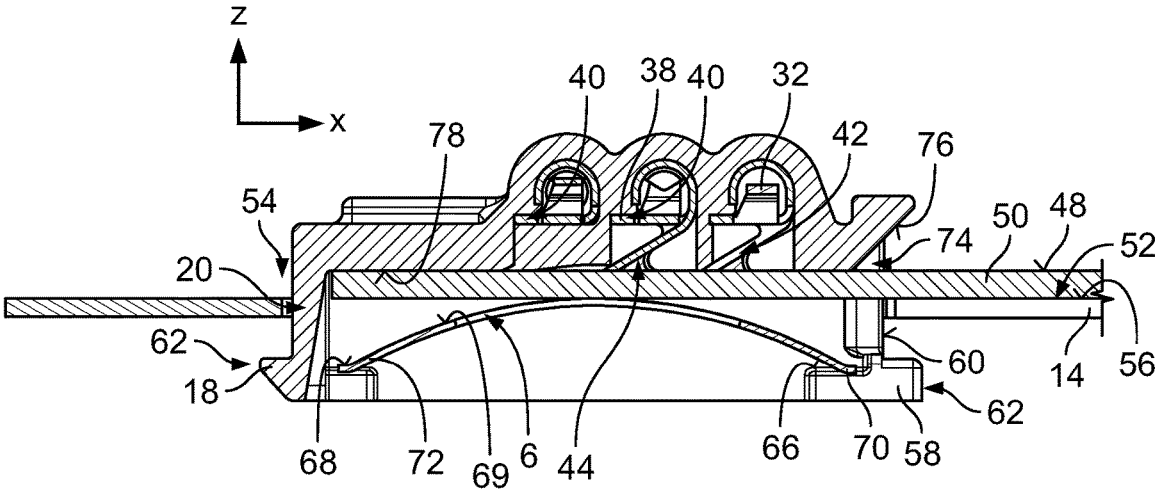
FIG. 5 is a sectional side view taken along line 5-5 of FIG. 4.

The bent sheet metal defining the contact 4 also defines a foot section 38, shown in FIG. 12, which is received within a foot receiving slot 40 formed by the connector housing 2 and shown in FIG. 5. Thus, the contact 4 inserted into the cylindrical receptacle 26 of the connector housing 2 is arranged within the connector housing 2 in a predetermined radial position. Any bending force generated by the contact leg 30 will not lead to a dislocation of the contact 4 within the connector housing 2 in the radial direction.

As shown in FIGS. 1 and 5, the connector housing 2 has a slide-in slot 42 adapted to receive the contact leg 30 when mounting the contact 4 within the connector housing 2. The slide-in slot 42 is open to the lateral side face 10 shown in FIG. 1 for lateral insertion of the contact 4. The slide-in slot 42 leads to a contact leg receptacle 44 of the connector housing 2 shown in FIG. 5. The contact leg receptacle 44 is adapted to receive the contact leg 30 after inserting the contact 4 into the connector housing 2. The contact leg receptacle 44 is provided as a cut-out within the connector housing 2 between two segments of the cylindrical receptacle 26 adapted to receive the long segments 28 of the contact 4 in a form-fit manner. Accordingly, after the contact leg 30 is received within the contact leg receptacle 44, each contact 4 is securely received at a predetermined axial position within the connector housing 2 in axial direction. The contact 4 can neither rotate about an axis defined by the cylindrical receptacle 26 nor be pushed out of the cylindrical receptacle 26 nor be dislocated in a radial direction with respect to the cylindrical receptacle 26; the contact 4 is held in a predetermined radial position in the cylindrical receptacle 26. Still further, and by cooperation of the foot section 38 and the foot receiving slot 40, the radial position and extension of the contact leg 30 within the connector housing 2 is determined.

Figure 4:
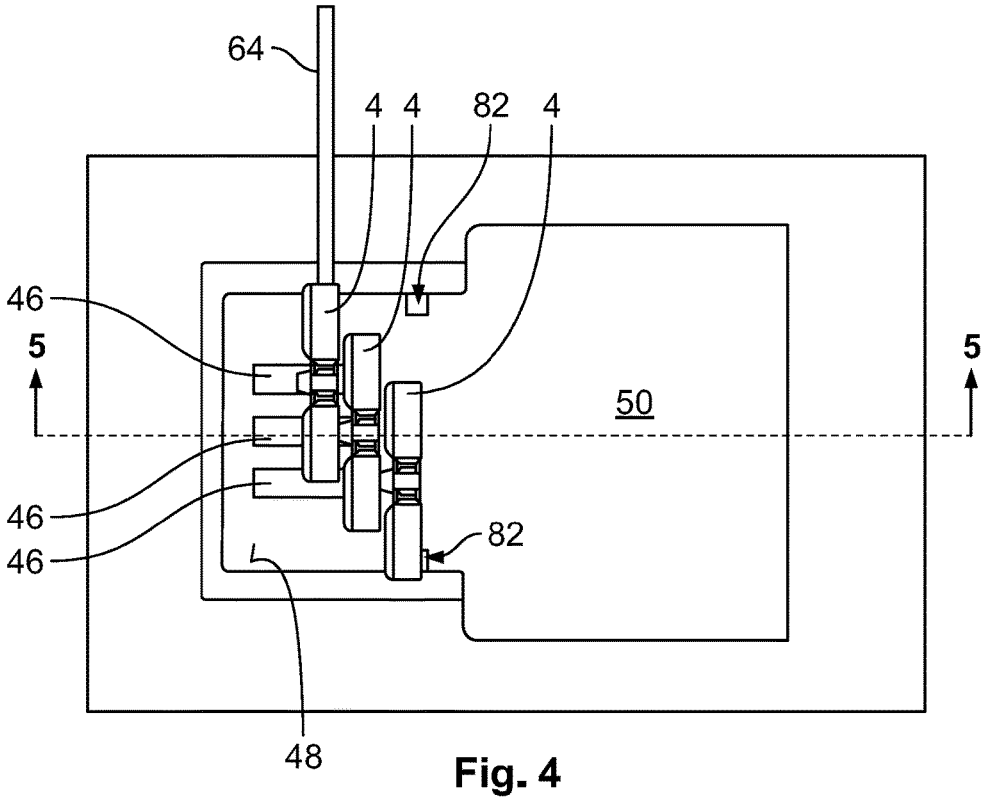
FIG. 4 is a top view of the interface module secured to the base with a connector housing removed.

As shown in FIGS. 2 and 4, each contact 4 is spaced apart in the insertion direction I to make contact with a contact surface 46 provided on an upper side 48 of the PCB 50. The contact surface 45 of the PCB 50 has a tin coating. Further, each contact 4 is spaced apart from the neighboring contact 4 in the y direction, i.e. perpendicular to the insertion direction I and parallel to a sliding plane defined by an upper side 52 of the base 14. The three contacts 4 connected to the connector housing 2 are adapted to each abut with their contact leg 30 with the three different contact surfaces 46 provided on the upper side 48 of the PCB 50. For economical reasons, the contacts 4 are designed identically.

Figure 3:
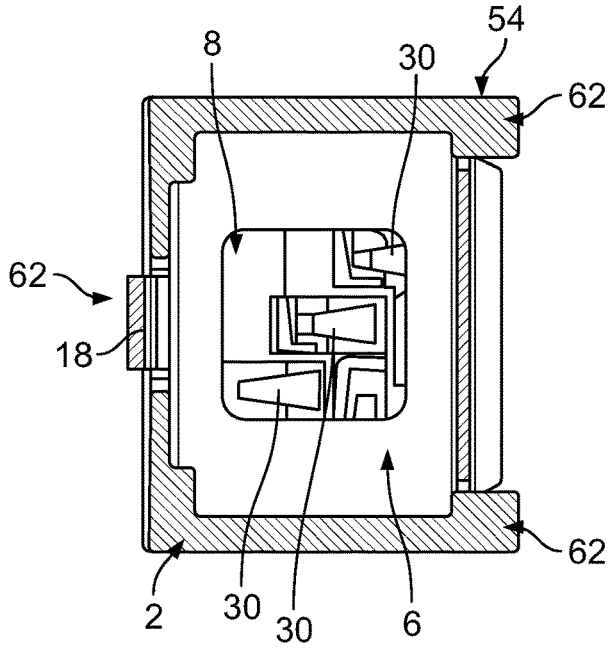
FIG. 3 is a bottom view of the interface module secured to the base.

As shown in FIG. 3, all three contact legs 30 of the three contacts 4 are positioned within the cut-out section 8 of the spring 6 in a preassembled state, in which the PCB 50 has not been inserted into the connector housing 2. FIG. 3 shows the base 14 from the underside in a state in which the connector housing 2 is inserted into a receptacle 54 of the base 14 being provided with a central cut-out forming the receptacle 54. This receptacle 54 is slightly larger than the circumference of the connector housing 2 to allow a certain degree of movability of the connector housing 2 in the insertion direction I in both the x and the z direction, wherein the x direction corresponds to the insertion direction I, and the y direction is perpendicular to the insertion direction and extends parallel to the upper side of the base 14 defining a planar sliding surface 56 for the PCB 50.

As shown in FIG. 5, first locking sections 58 which are arranged on the connector housing 2 project beyond a front surface 60 of the connector housing 2 and project underneath the base 14 for securing the connector housing 2 in a positive manner. The connector housing 2 is first inserted into the receptacle 54 in an inclined orientation to place the first locking section 58 underneath the base 14. Then, the connector housing 2 is pivoted in a counter-clockwise direction with respect to the drawing of FIG. 5 to slide the second locking section 18 underneath the base 14, thereby pretensioning the locking pawl 20 to provide a reliable form fit defining a lower stop 62 preventing the connector housing 2 from being pulled out of the receptacle 54 in the z direction.

Afterwards, the connector housing 2 is allowed to move in the z direction between the lower stops 62 and the upper stops 12.

After connecting the connector housing 2 to the base 14, stripped wires 64 shown in FIGS. 2 and 4 are inserted into each cable receptacle 34 of each contact 4 from either one or two sides. The stripped wires 64 are inserted from both sides of each contact 4 in an embodiment for providing multiple PCB interface modules in series. The stripped wire 64 contact the securing hook 32 within the cylindrical receptacle 26 which cuts into the conductive core of the cable 46 and thus secures the cable 46 mechanically to the contact 4 in an electrically conductive manner.

Figure 8A:
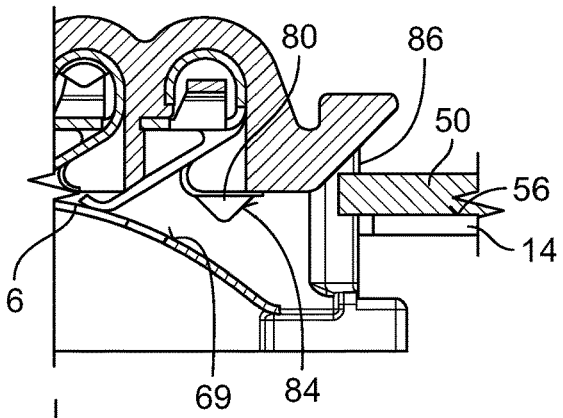
FIG. 8A is a sectional side view of a first step of mounting a PCB within the connector housing of the interface module.
Figure 8B:
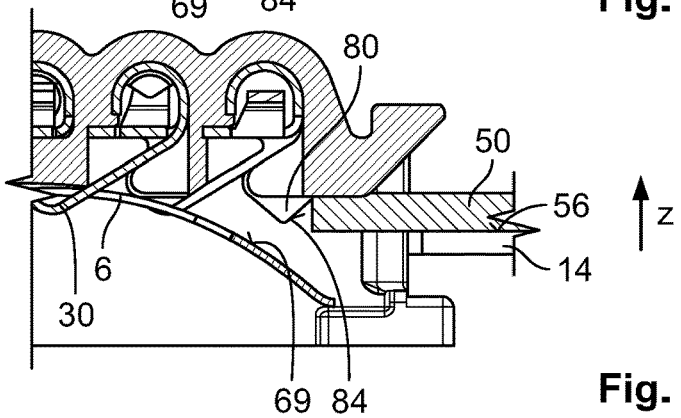
FIG. 8B is a sectional side view of a second step of mounting the PCB within the connector housing.

The connection of the spring 6 within the connector housing 2 is shown in FIG. 5. The connector housing 2 provides opposite supporting surfaces 66, 68 defined by inward steps provided by the connector housing 2 and each defining a support for the spring 6 which has a curvilinear configuration such that a convex contact surface 69 protrudes towards the contacts 4. As shown in FIGS. 8A and 8B, the free ends of the contact legs 30 are provided within the cut-out section 8 of the respective spring 6 in the preassembled state. The spring 6 has the front abutment surface 70 and an opposite rear abutment surface 72.

Figure 6:
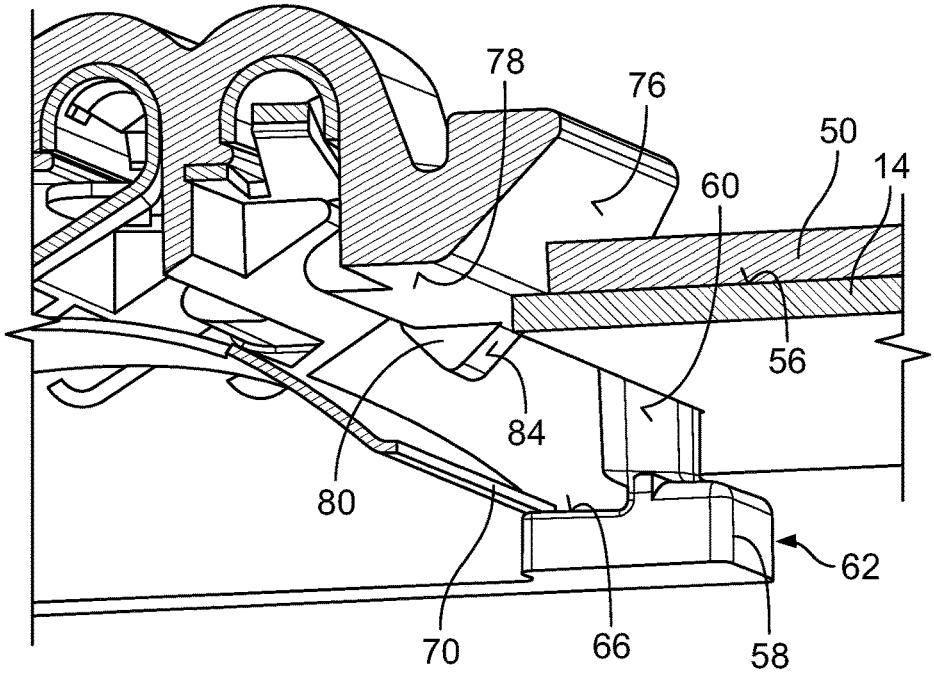
FIG. 6 is a sectional perspective view taken along line 5-5 of FIG. 4 during a step of a mounting process.
Figure 7:
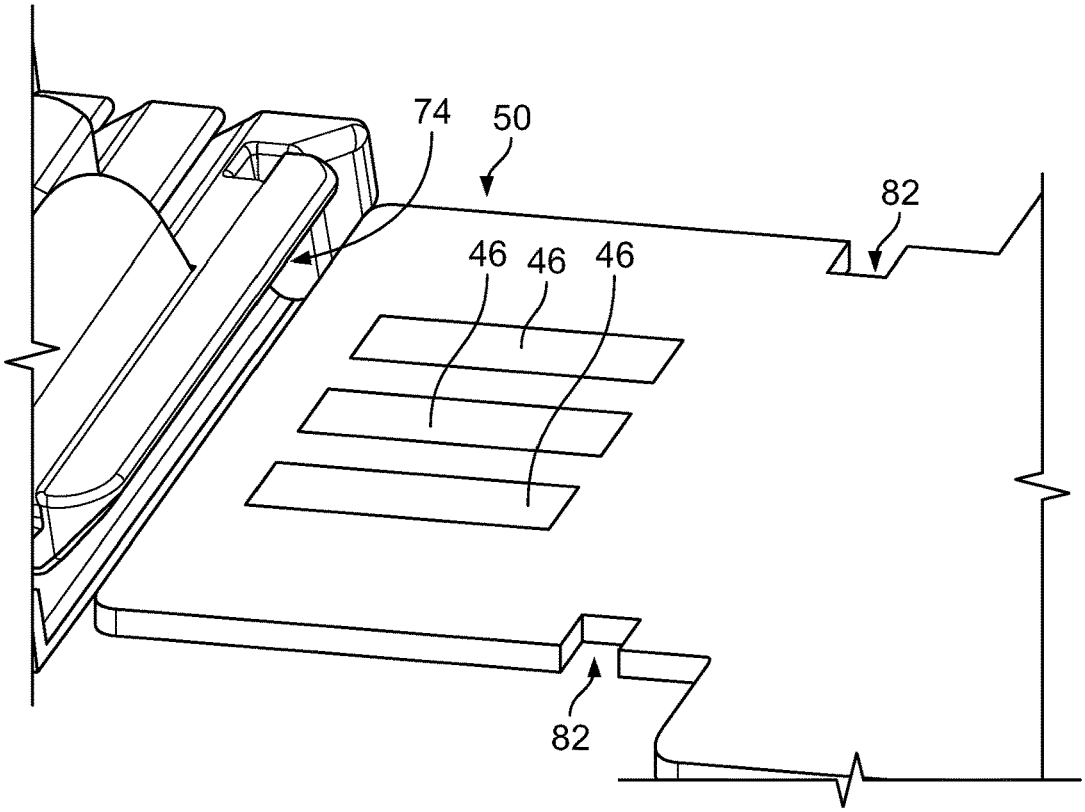
FIG. 7 is a perspective view of the step of the mounting process shown in FIG. 6.

In order to accommodate different thicknesses of the PCB, which will be described hereinafter by referring to FIGS. 10A-10C, at least one supporting surface 66 shown in FIG. 5 is provided as a sliding support for the front abutment surface 70 of the spring 6. An insertion opening 74 is recessed in the front surface 60 which is adapted to lead the PCB 50 into the connector housing 2. For this, the insertion opening 74 is provided with an upper oblique guiding surface 76 which extends oblique to the sliding surface 56 and guides the PCB 50 towards a planar supporting surface 78 formed by the connector housing 2 and shown in FIGS. 5 and 6. The oblique guiding surface 76 leads to the planar supporting surface 78. In the insertion opening 74, two securing notches 80 are provided at the lateral end sections of the insertion opening 74. Those securing notches 80 have a V-shaped configuration projecting as a triangle in cross-sectional direction into the connector housing 2 as shown in FIG. 6. Those securing notches 80 are adapted to cooperate with rectangular form-fit cut-outs 82 provided on the opposite lateral sides of the PCB 50 and shown in FIG. 7. Due to the triangular configuration, the securing notch 80 defines a chamfered guiding surface 84, the function of which will be described hereinafter with reference to FIGS. 8A-9.

Figure 8C:
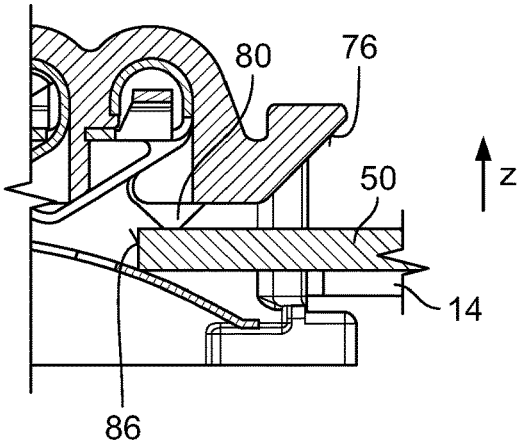
FIG. 8C is a sectional side view of a third step of mounting the PCB within the connector housing.
Figure 8D:
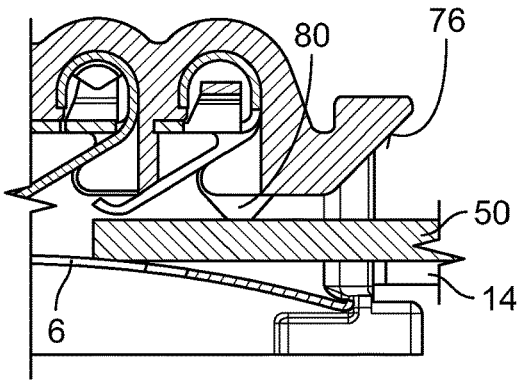
FIG. 8D is a sectional side view of a fourth step of mounting the PCB within the connector housing.
Figure 8E:
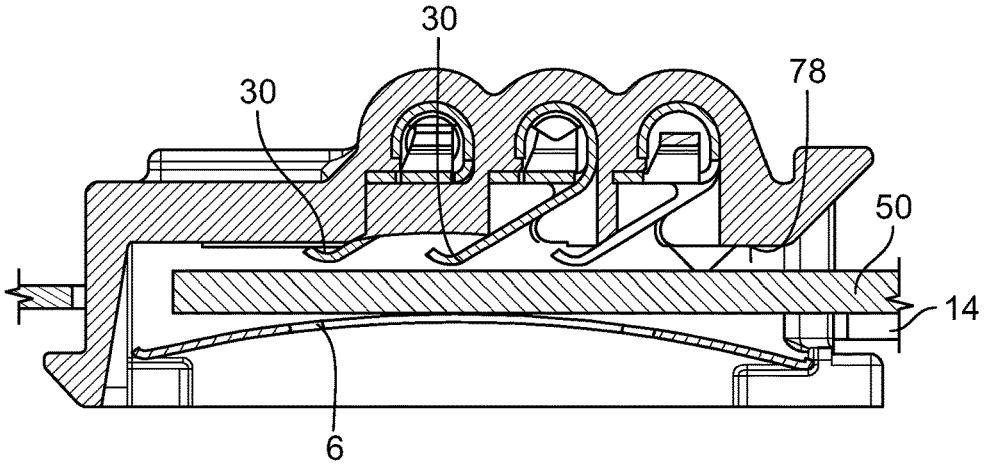
FIG. 8E is a sectional side view of a fifth step of mounting the PCB within the connector housing.
Figure 8F:
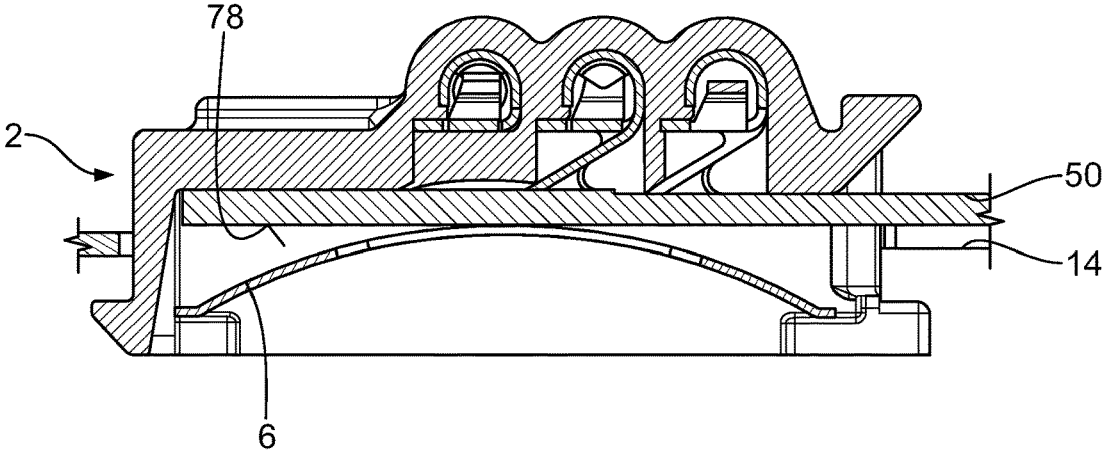
FIG. 8F is a sectional side view of a fully mounted state of the PCB within the connector housing.
Figure 9:
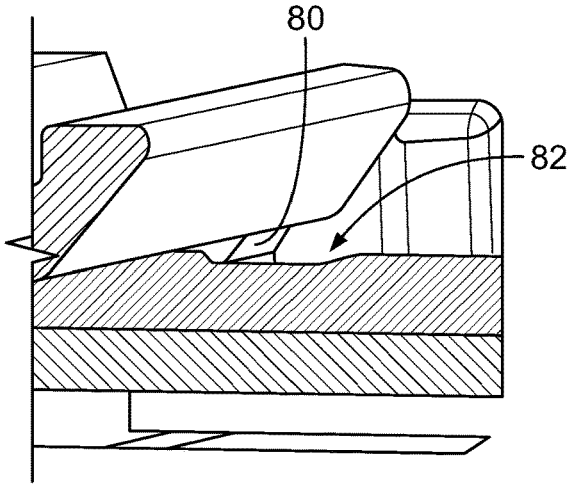
FIG. 9 is a sectional perspective view of the fifth step of mounting the PCB within the connector housing.

FIGS. 8A-9 describe vertical movement of the connector housing 2 relative to the base 14 in the course of assembling the PCB 50 within the connector housing 2.

In FIG. 8A, the PCB 50 is arranged on the planar sliding surface 56 provided by the base 14. When pushing the PCB 50 in the insertion direction I towards the connector housing 2, an end face 86 of the PCB 50 comes into contact with the oblique guiding surface 76 thereby pushing the connector housing 2 upward in the z direction as shown in FIGS. 8A and 8B. In FIG. 8B, the upper side 48 of the PCB 50 lies against the planar supporting surface 78 provided by the connector housing 2.

Advancing the PCB 50 further into the connector housing 2 in the insertion direction I, the end face 86 contacts the chamfered guiding surface 84 of the securing notch 80. Due to this, the connector housing 2 is further lifted in the z direction as shown in FIG. 8C. As a consequence, the upper side 48 of the PCB 50 will slide below the lowest surface section of the contact leg 30 as shown in FIG. 8D. Thus, a direct contact of the contact 4 with the end face of the PCB 86 in the course of assembling the PCB 50 within the connector housing 2 is avoided, which avoids harming the contact leg 30. In FIG. 8E, the PCB 50 has been further advanced into the connector housing 2, thereby passing all contact legs 30.

In FIGS. 8E and 9, the securing notches 80 are just about to enter into the form-fit cut-outs 82 of the PCB 50. Further advancing the PCB 50 leads to a form-fit connection of the securing notches 80 in the form-fit cut-outs 82. This positive locking is secured by the spring force of the spring 6, which urges the PCB 50 with the planar upper side 48 against the planar supporting surface 78 defined by the connector housing 2 as shown in FIG. 8F. The spring force generated by the spring 6 usually is stronger than any elastic force of the at least one contact leg 30 abutting against the PCB 50.

In FIG. 8F, the contact leg 30 is not shown in a deflected state; the contact leg 30 contacts the upper side 52 of the PCB 50, specifically the assigned contact surface 46 of the PCB 50. Due to the positive fit between the securing notches 80 and the form-fit cut-outs 82, both the PCB 50 and the connector housing 2 may slide in the x direction and/or the z direction without causing any relative movement between the contact surfaces provided between the contact leg 30 and the contact surfaces 46 on the upper side 48 of the PCB 50, respectively. Only after matching the notches 80 with the form-fit cut-outs 82 of the PCB 50 will the connector housing 2 be lowered and, thus, the contact 4 will make electrical contact with the contact surface 45 on the upper side 48 of the PCB 50. Thus, fretting corrosion is effectively prevented. With electrical contact between the tin coating of the contact 4 and the tin coating of the contact surface 45 of the PCB 50, fretting corrosion may be fully avoided.

Figure 10A:
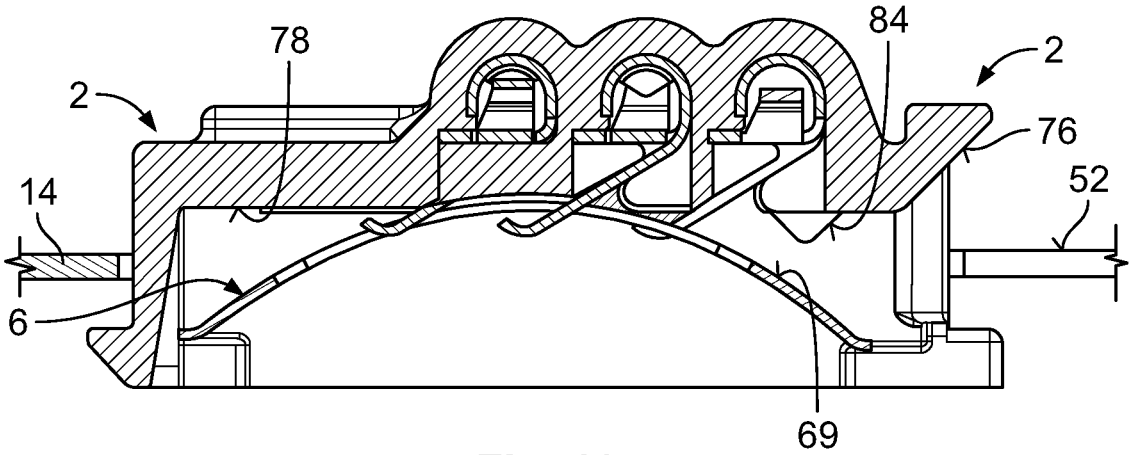
FIG. 10A is a sectional side view of a preassembled state in which the PCB is not disposed within the connector housing.
Figure 10B:
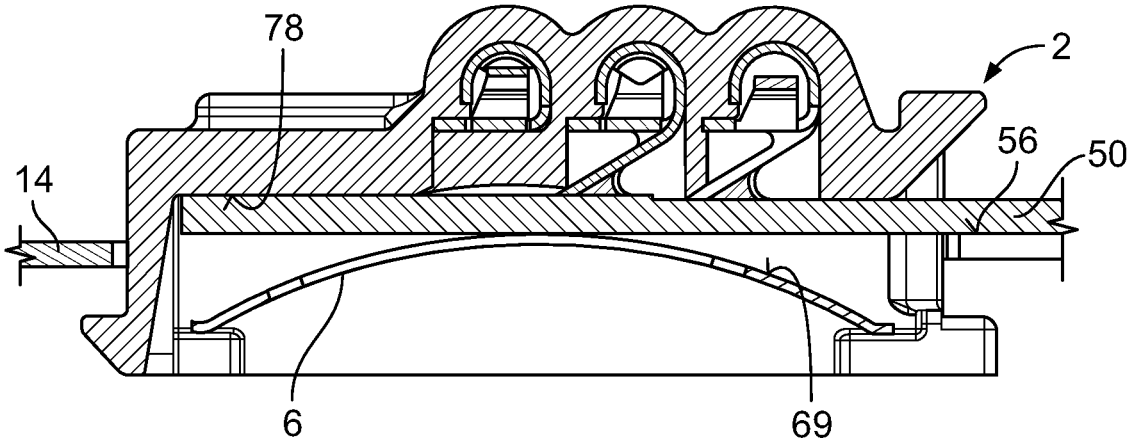
FIG. 10B is a sectional side view of a PCB of a first thickness received within the connector housing.
Figure 10C:
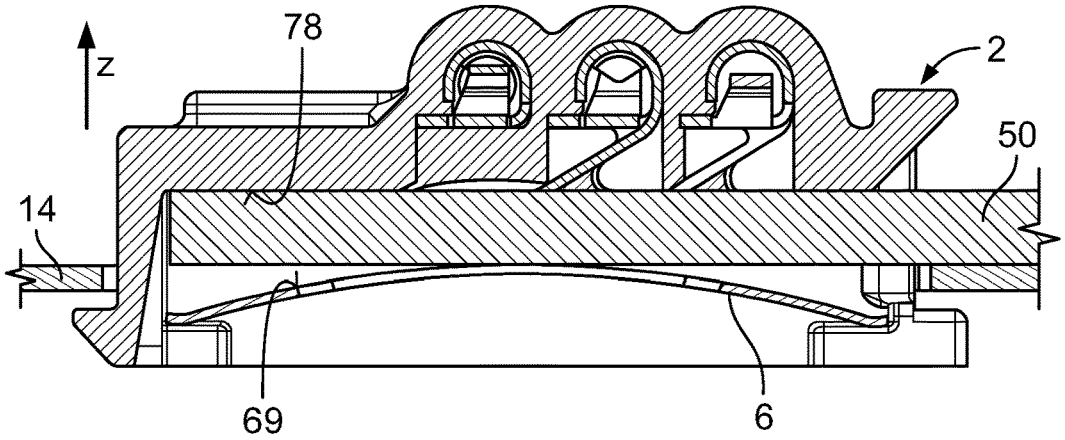
FIG. 10C is a sectional side view of a PCB with a second thickness received within the connector housing.

Compensation of different PCB thicknesses is shown in FIGS. 10A-10C. FIG. 10A shows a preassembled state in which no PCB is received within the connector housing 2, whereas a rather thin PCB, with a thickness of 0.8 mm, is received within the connector housing 2 in FIG. 10B and a rather thick PCB, with a thickness of 1.8 mm, is received within the connector housing 2 in FIG. 10C. Such rather thick PCB 50 leads to a considerable deflection of the spring 6 in the assembled state. The spring 6 can slide with its abutment surface 70 relative to the supporting surface 66. Varying PCB thicknesses lead to differences in the positioning of the connector housing 2 relative to the planar sliding surface 56 provided by the base 14. With a large thickness of the PCB 50, the connector housing 2 is rather lifted as shown in FIG. 10C, whereas with a thin PCB 50, the connector housing 2 is lowered. The connector housing 2 is moved in the z direction between the upper and lower stops 12, 62. Irrespective of the thickness of the PCB 50, the upper side 48 of the PCB 50 will always assume a predetermined position in the assembled state; the contact leg 30 will always contact the contact surface 46 on the upper side 48 of the PCB 50 with a predetermined pretension.

Figure 14:
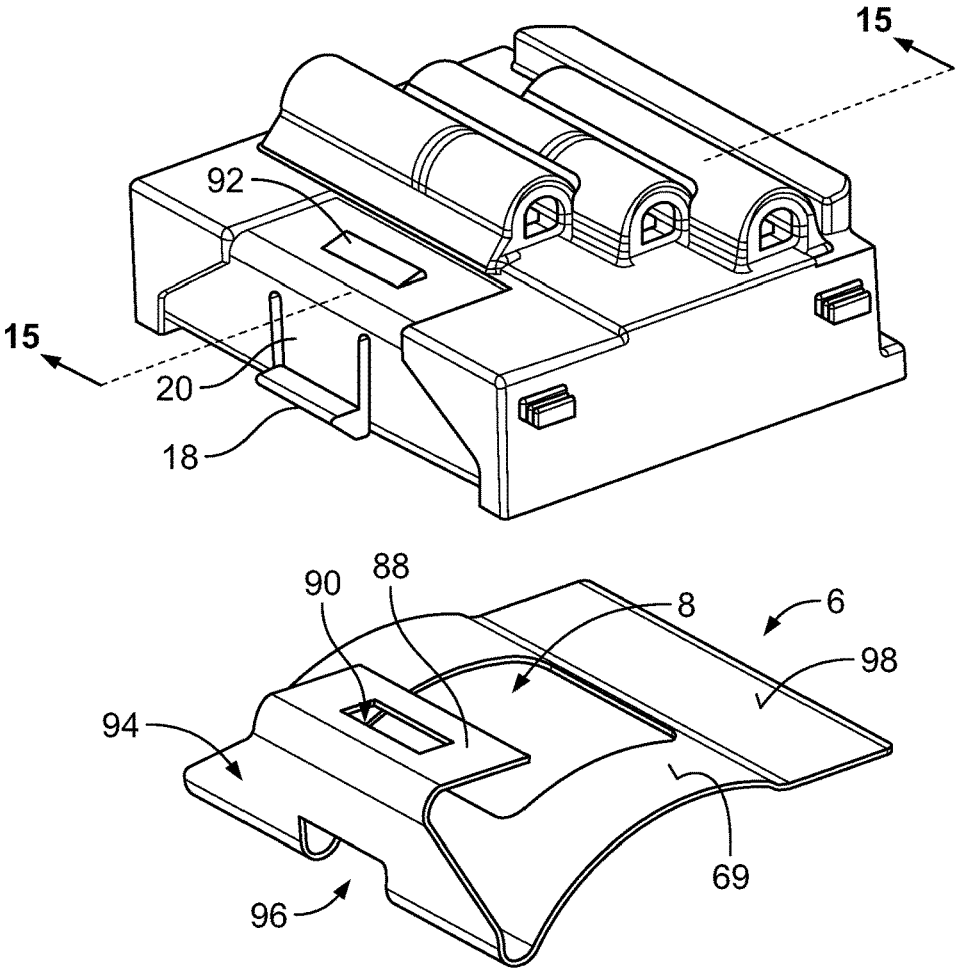
FIG. 14 is an exploded perspective view of an interface module according to another embodiment.
Figure 15:
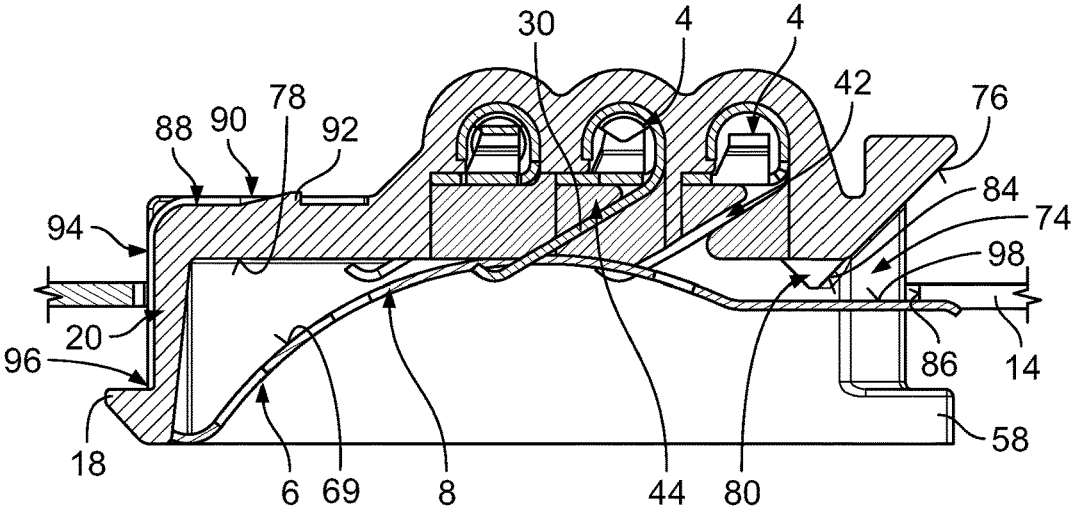
FIG. 15 is a sectional side view of the interface module taken along line 15-15 of FIG. 14.

An interface module according to another embodiment is shown in FIGS. 14 and 15. Like reference numbers indicate like elements and only the differences with respect to the interface module shown and described with respect to FIGS. 1-13 will be described in detail herein. The interface module in FIGS. 14 and 15 has a C-shaped spring 6.

The C-shaped spring 6, as shown in FIGS. 14 and 15, has a securing end 88 which is adapted to grasp around the rear end of the connector housing 2 and provided with a holding cut-out 90 recessed in the planar securing end 88 and adapted to cooperate with the holding projection 92 unitarily formed by the connector housing 2. The securing end 88 and an intermediate section 94 of the spring 6 are bent to define an angle smaller than 90°. After clamping the C-shaped spring 6 against the connector housing 2, the securing end 88 and the intermediate section 94 of the spring 6 lie against perpendicular outer surfaces of the connector housing under pre-tension, while the holding projection 92 extends through the holding cut-out 90. Thus, the spring 6 is securely attached to the connector housing 2.

As in the first embodiment, the C-shaped spring 6 has a cut-out section 8. A further cut-out 96 is provided in the transition between the intermediate section 94 and the curvilinear contact surface 69 to expose the locking pawl 20 and the second locking section 18 to allow a swiveling movement of the locking pawl 20. In the preassembled state shown in FIG. 15, the cut-out section 8 receives the front ends of the contact legs 30 projecting below the planar supporting surface 78 for the PCB 50.

As shown in FIG. 15, the other end of the spring 6 is freely suspended within the insertion opening 74. Within the insertion opening 74, the spring 6 provides a planar spring sliding surface 98 which extends essentially parallel to the planar supporting surface 78. In the preassembled state shown in FIG. 15, the free end of the spring 6 has been projected underneath the base 14. Thus, a PCB sliding over the planar sliding surface 56 is eventually pushed on the upper side of the spring sliding surface 98 to advance into the connector housing 2. In the second embodiment, the chamfered guiding surface 84 continues with the inclination and direction of the oblique guiding surface 78. Thus, a continuous guiding for an end face 86 of the PCB 50 is provided.

The C-shaped spring 6 can be connected to the connector housing 2 at a solid rear end thereof. Thus, the connection is more durable and can sustain stronger bending such as e.g. spring forces acting against the PCB 50 to hold the same against the planar supporting surface 78 provided by the connector housing 2.

In an embodiment, the PCB 50 is a user authentication card and electrically contacts a linear LED lighting comprising a plurality of LEDs arranged in a longitudinal direction of the linear LED lightning and electrically connected in series with each other. In such an embodiment, the base 14 is a luminaire mechanically supporting and holding the linear LED lightning. This lightning can be mechanically adhered to the base 14.

What is claimed is:

1. An interface module, comprising:

a base defining a planar sliding surface for a male contact element;

a connector housing formed of an electrically insulating material and movably received in a receptacle of the base, the connector housing having an insertion opening adapted to receive the male contact element;

a contact received in the connector housing and arranged above the planar sliding surface, the contact having a contact leg projecting below a planar supporting surface for the male contact element defined by the connector housing in a preassembled state; and a spring disposed opposite the contact in a direction perpendicular to the sliding surface and adapted to elastically abut against an underside of the male contact element in an assembled state of the male contact element, the male contact element is received within the insertion opening of the connector housing and the contact leg abuts a contact surface on an upper side of the male contact element in the assembled state.

2. The interface module of claim 1, wherein the connector housing is movable in a direction perpendicular to the planar sliding surface between an upper stop and a lower stop of the connector housing.

3. The interface module of claim 1, wherein the contact has a long segment adapted to receive and to be electrically connected to a cable.

4. The interface module of claim 3, wherein the connector housing defines a cylindrical receptacle adapted to receive the contact in a predetermined radial position in which the contact leg projects below the planar supporting surface in the preassembled state.

5. The interface module of claim 4, wherein the contact has a pair of opposite long segments each adapted to receive and be electrically connected to one cable from opposite sides, the contact leg is disposed between the pair of opposite long segments.

6. The interface module of claim 4, wherein the contact is secured to the connector housing at a predetermined axial position in an axial direction of the cylindrical receptacle.

7. The interface module of claim 1, wherein the connector housing has a securing notch projecting from the planar supporting surface.

8. The interface module of claim 7, wherein the male contact element has a form-fit cut-out in which the securing notch is received in the assembled state.

9. The interface module of claim 8, wherein the connector housing is slidably received in the receptacle in an insertion direction of the male contact element into the connector housing.

10. The interface module of claim 9, wherein the securing notch is disposed at the insertion opening and has a chamfered guiding surface adapted to cooperate with the male contact element to force the male contact element below the planar supporting surface.

11. The interface module of claim 1, wherein the spring is secured to the connector housing.

12. The interface module of claim 11, wherein the spring has a pair of opposite abutment surfaces which engage a pair of opposite supporting surfaces of the connector housing, at least one of the pair of opposite abutment surfaces is slidably supported against one of the pair of opposite supporting surfaces.

13. The interface module of claim 11, wherein the spring has a C-shaped configuration and is fixed with a securing end to the connector housing, an end of the spring opposite the securing end is freely suspended near the insertion opening.

14. The interface module of claim 13, wherein the end of the spring opposite the securing end provides a planar spring sliding surface extending parallel to the planar sliding surface of the base.

15. The interface module of claim 1, wherein the spring is formed of a unitary metal sheet having a cut-out section in which the contact leg is arranged in the preassembled state and the spring provides a curvilinear contact surface protruding towards the contact.

16. The interface module of claim 1, further comprising a plurality of contacts, the contact legs of the contacts are spaced apart both perpendicular to an insertion direction of the male contact element into the connector housing and in the insertion direction.

17. The interface module of claim 1, wherein the connector housing has a first locking section and a second locking section disposed at opposite ends of the connector housing and each projecting underneath the base.

18. The interface module of claim 17, wherein the second locking section is disposed on a free end of an elastic locking pawl and the first locking section and the second locking section define a plurality of lower stops limiting a movement of the connector housing in a direction perpendicular to the planar sliding surface.

* * * * *